US009840761B2

(12) United States Patent
Tundal et al.

(10) Patent No.: US 9,840,761 B2
(45) Date of Patent: Dec. 12, 2017

(54) AL—MG—SI ALUMINIUM ALLOY WITH IMPROVED PROPERTIES

(71) Applicant: Norsk Hydro ASA, Oslo (NO)

(72) Inventors: Ulf Tundal, Sunndalsora (NO); Oddvin Reiso, Sunndalsora (NO); Svein Roger Skjervold, Trondheim (NO); Angela Dawne Kubiak, Tonder (DK)

(73) Assignee: NORSK HYDRO ASA, Oslo (NO)

( * ) Notice: Subject to any disclaimer, the term of this patent is extended or adjusted under 35 U.S.C. 154(b) by 336 days.

(21) Appl. No.: 14/395,586

(22) PCT Filed: Apr. 25, 2013

(86) PCT No.: PCT/NO2013/000015

§ 371 (c)(1),
(2) Date: Oct. 20, 2014

(87) PCT Pub. No.: WO2013/162374

PCT Pub. Date: Oct. 31, 2013

(65) Prior Publication Data

US 2015/0129090 A1 May 14, 2015

(30) Foreign Application Priority Data

Apr. 25, 2012 (NO) ..... 20120479

(51) Int. Cl.
*C22F 1/05* (2006.01)
*C22C 21/08* (2006.01)
(Continued)

(52) U.S. Cl.
CPC ..... *C22F 1/047* (2013.01); *C22C 21/02* (2013.01); *C22C 21/08* (2013.01); *C22F 1/043* (2013.01); *C22F 1/05* (2013.01)

(58) Field of Classification Search
CPC ..... C22F 1/04–1/057; C22C 21/00–21/18
See application file for complete search history.

(56) References Cited

U.S. PATENT DOCUMENTS

2010/0089503 A1 4/2010 Inagaki et al.

FOREIGN PATENT DOCUMENTS

CN 102337429 2/2012
JP 2003-155535 5/2003
(Continued)

OTHER PUBLICATIONS

International Search Report dated Jul. 8, 2013 in International (PCT) Application No. PCT/NO2013/000015.

*Primary Examiner* — Lois Zheng
(74) *Attorney, Agent, or Firm* — Wenderoth, Lind & Ponack, L.L.P.

(57) ABSTRACT

Extrudeable Al—Mg—Si aluminum alloy with improved strength, corrosion resistance, crush properties and temperature stability, in particular useful in or close to the front part of vehicles. The composition of the alloy is defined within the following coordinate points of an Mg—Si diagram: a1-a2-a3-a4, where in wt % a1=0.60 Mg, 0.65Si, a2=0.90Mg, 1.0Si, a3=1.05Mg, 0.75Si and a4=0.70Mg, 0.50Si and where the alloy has a non-recrystallized grain structure in the extruded profile containing in addition the following alloy components in wt %: Fe up to 0.30 Cu 0.1-0.4 Mn 0.4-1.0 Cr up to 0.25 Zr up to 0.25 and Ti 0.005-0.15 incidental impurities up to 0.1 each and including Zn up to 0.5 with balance Al.

14 Claims, 19 Drawing Sheets

(51) Int. Cl.

| | |
|---|---|
| ***C22F 1/047*** | (2006.01) |
| ***C22F 1/043*** | (2006.01) |
| ***C22C 21/02*** | (2006.01) |

(56) References Cited

FOREIGN PATENT DOCUMENTS

| | | | | |
|---|---|---|---|---|
| JP | 2003-181530 | * | 7/2003 | ..... B21C 23/00 |
| JP | 2011-106011 | | 6/2011 | |
| JP | 2011-225988 | | 11/2011 | |
| WO | 2011/122958 | | 10/2011 | |

* cited by examiner

AL—MG—SI ALUMINIUM ALLOY WITH IMPROVED PROPERTIES

The present invention relates to an Al—Mg—Si aluminium alloy with improved strength, corrosion resistance, crush properties and temperature stability.

Alloys of the above-mentioned type are required for instance in the front structure of vehicles where aluminium components are exposed to corrosive environments, high temperatures (when used in or close to the engine) and, the alloy concurrently requires high strength and good crush properties.

A material standard of a leading car producer specifies material properties of extruded aluminium alloys for use in cars. Currently, the most challenging strength class (C28) has the following main requirements:

Rp0.2>280 MPa

Good behaviour upon axial crush testing of hollow sections (only minor cracks allowed)

Rp0.2>265 MPa after 1000 hours at 150° C.

Good corrosion properties

For the next strength class (C24) the requirements for Rp0.2 are minimum 240 MPa before temperature exposure and minimum 230 MPa after 1000 hours at 150° C. The denotations "C24", "C28" etc. used above and later in this application refer to the tensile yield strength property, Rp0.2, of the alloy; for example C28 refers, as indicated above, to a requirement of Rp0.2>280 MPa and C24 to Rp0.2>240 MPa.

A number of alloys have been developed for the use in cars having high ductility and strength. An example of such an alloy is known from U.S. Pat. No. 4,525,326/Swiss Aluminium) which discloses an Al—Mg—Si alloy containing by wt % 0.3-1.0 Mg and 0.3-1.2 Si and where vanadium, V, is added for improving the alloy's ductility. In this patent it is claimed that additions of V in the range 0.05-0.20 wt. % in combination with a Mn content defined to be within ¼ to ⅔ of the Fe content, significantly improves the ductility of a wide range of Al—Mg—Si alloys. Titanium, Ti, is not mentioned in this U.S. Pat. No. 4,525,326 publication.

A similar alloy is known from EP 2072628 (Aleris) defining Mg between 0.6 and 0.95 and Si between 0.5-0.95 wt % and which also contains Vanadium (V) and in addition Nickel (Ni). Ni is added to improve yield strength and tensile strength and thermal stability. The amount of Mn is between 0.1 and 0.3 wt %.

EP 2 103 701 B1 (Brökelmann) describes an alloy composition which is very narrow with regard to Mg (0.58-0.67 wt %) and Si (0.68-0.77 wt %) and which further contains narrow amounts of Cu (0.24-0.32 wt %) and Mn (0.68-0.77 wt %). The alloy allegedly has improved yield and tensile strength, but is likely less temperature stable than an alloy with a higher Mg/Si ratio.

EP 1 041 165 (Kobe) relates an Al—Mg—Si alloy composition with 0.30-0.70 wt % Mg and 0.10-0.50 wt % Si. However, due to the low contents of Mn, Cr and Zr this known alloy will in most cases produce recrystallised structure in the extruded profile.

This is also the case with EP 2 157 200 A1 (Aisin/Sumitomo) and DE 10 2008 048 374 A1 (Honsel) which are also low on elements (Mn, Cr and Zr) producing dispersoid particles during the homogenising process (see later section discussing these particles).

With the present invention is provided an Al—Mg—Si alloy which not only has high tensile and yield strength, but which at the same time has improved crush properties and is temperature stable.

The alloy is developed for extruded products where good crush behaviour, ductility, etc. are required, however, it may be used for additional purposes (e.g. forging of cast billets).

The invention is characterized by the features as defined in the attached independent claim 1 and dependent claims 2-12.

The invention will be further described in the following by way of examples and with reference to the figures, where:

and to the right a sample in overaged condition with Rp0.2=280 MPa (T7—Ageing for 6 hours at 170° C.)

Figure 19:
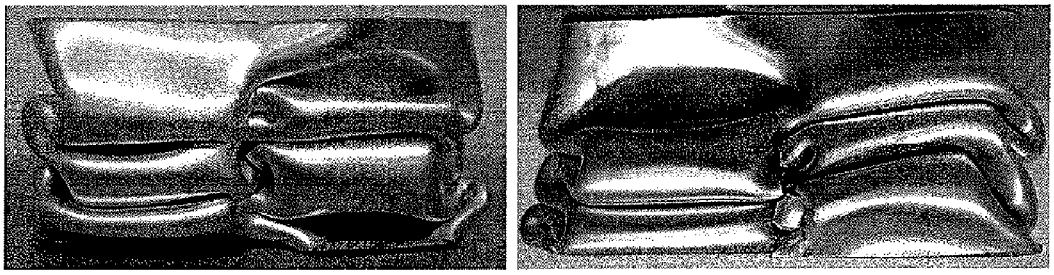

FIG. 19 shows pictures of crushed samples of alloy C28-B2 according to the invention where the left picture shows a sample in overaged condition with Rp0.2=289 MPa (T7—Ageing for 5 hours at 205° C.) and to the right a sample in peak strength condition with Rp0.2=303 MPa (T6—Ageing for 6 hours at 185° C.).

Figure 20:
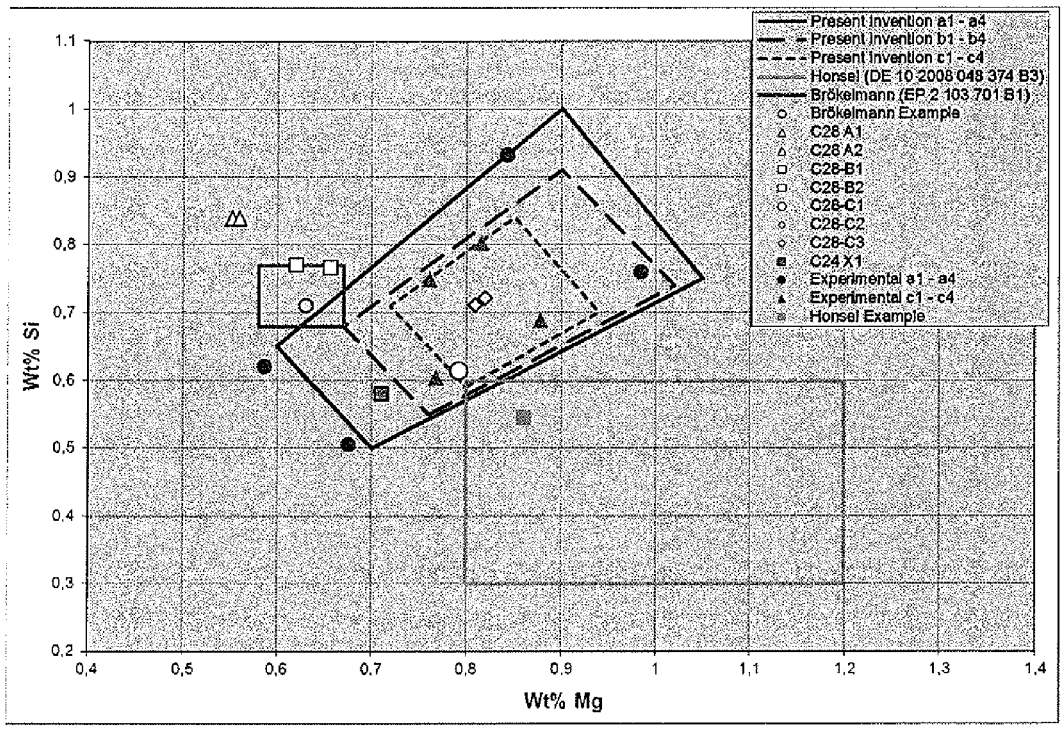
Figure 21:
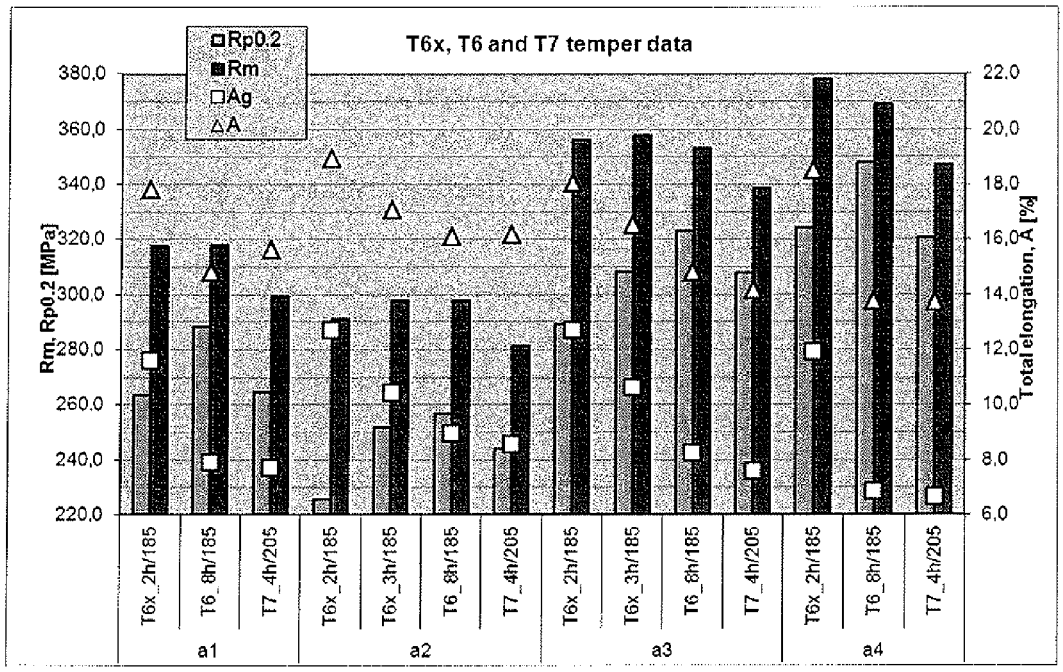
Figure 22:
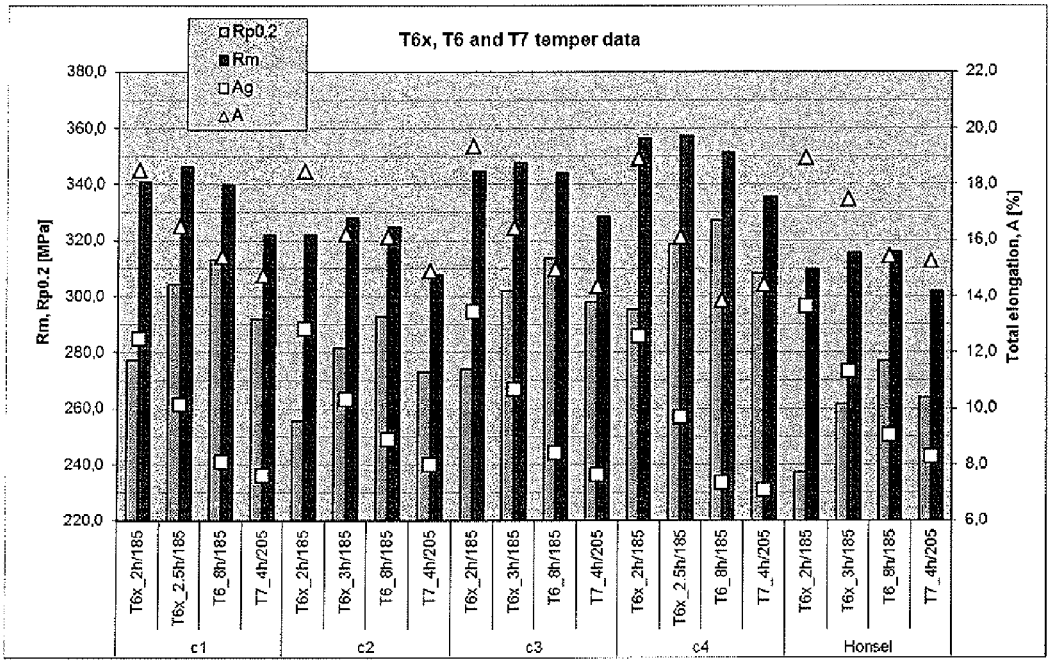
Figure 23:
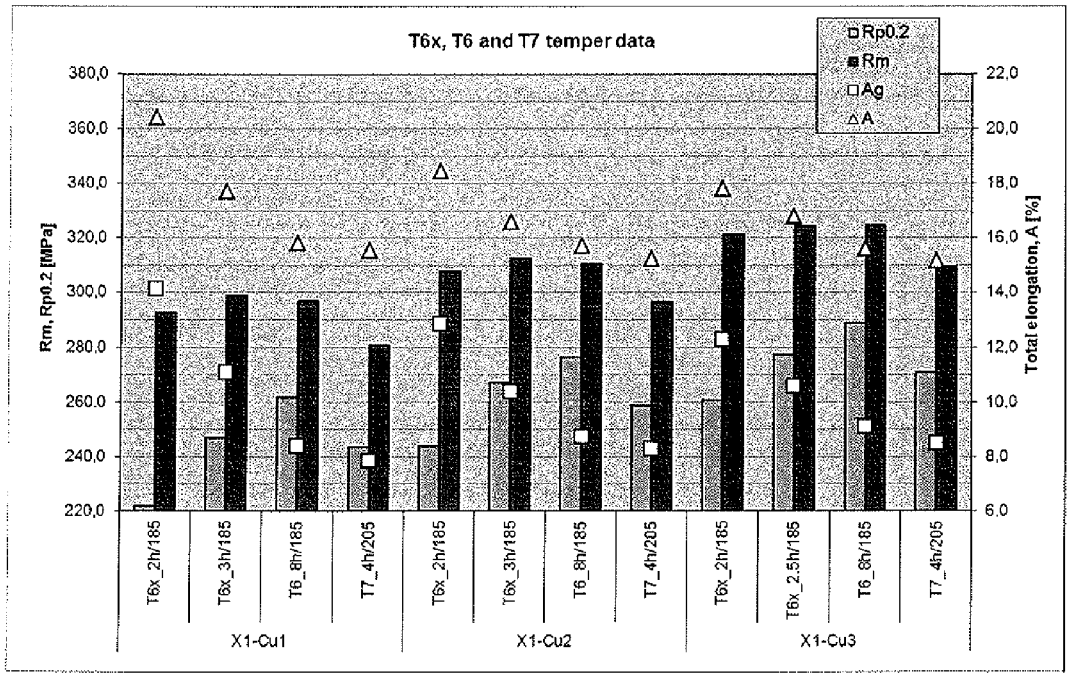
Figure 24:
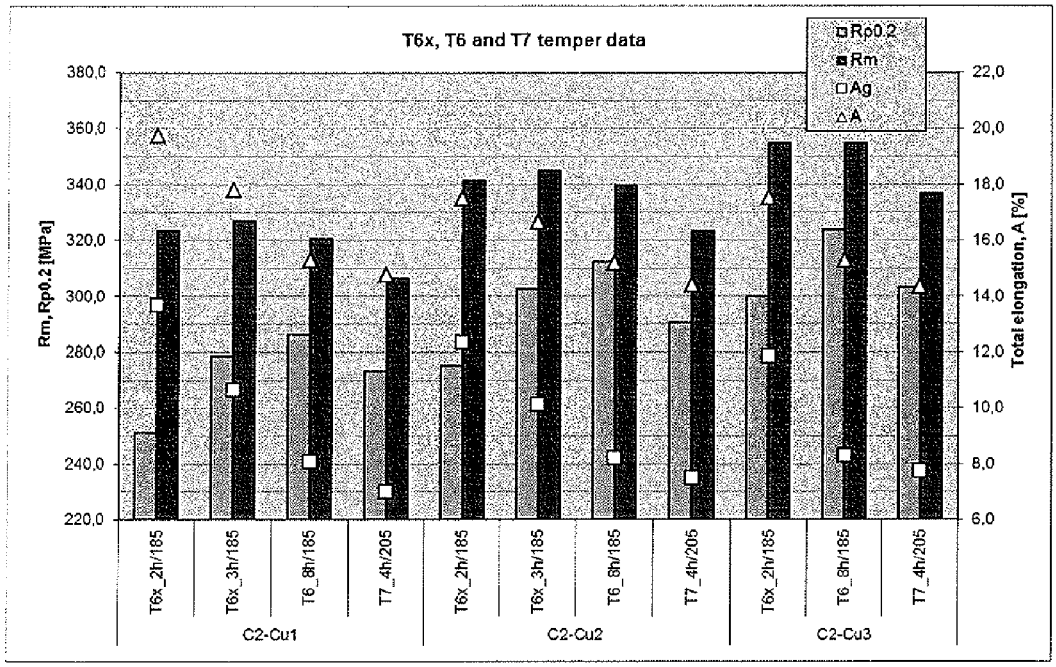
Figure 25:
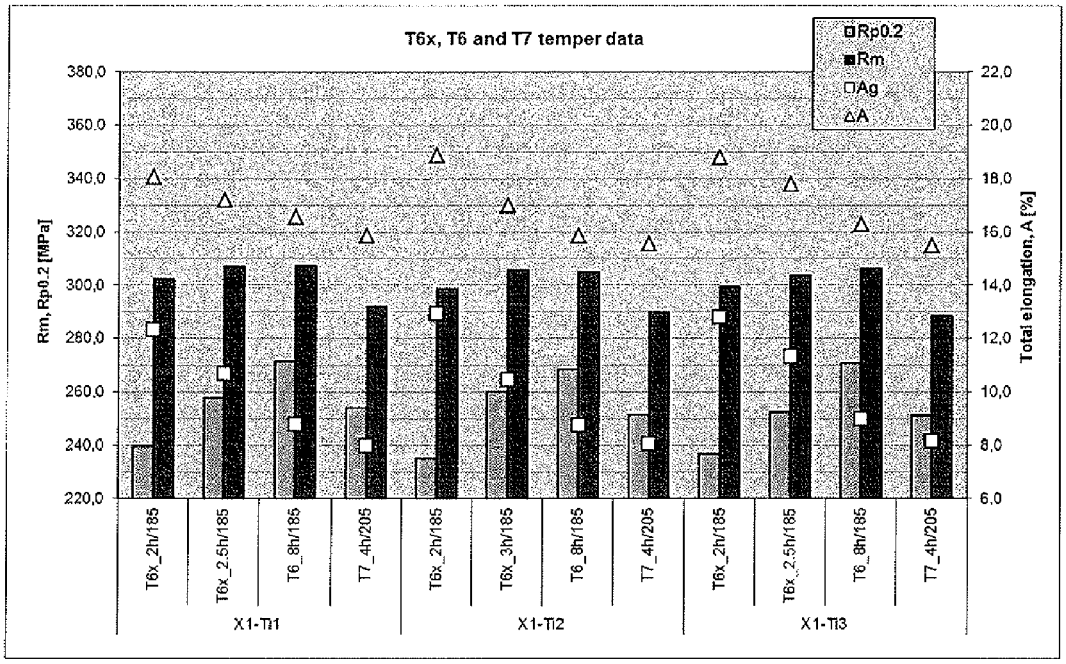
Figure 26:
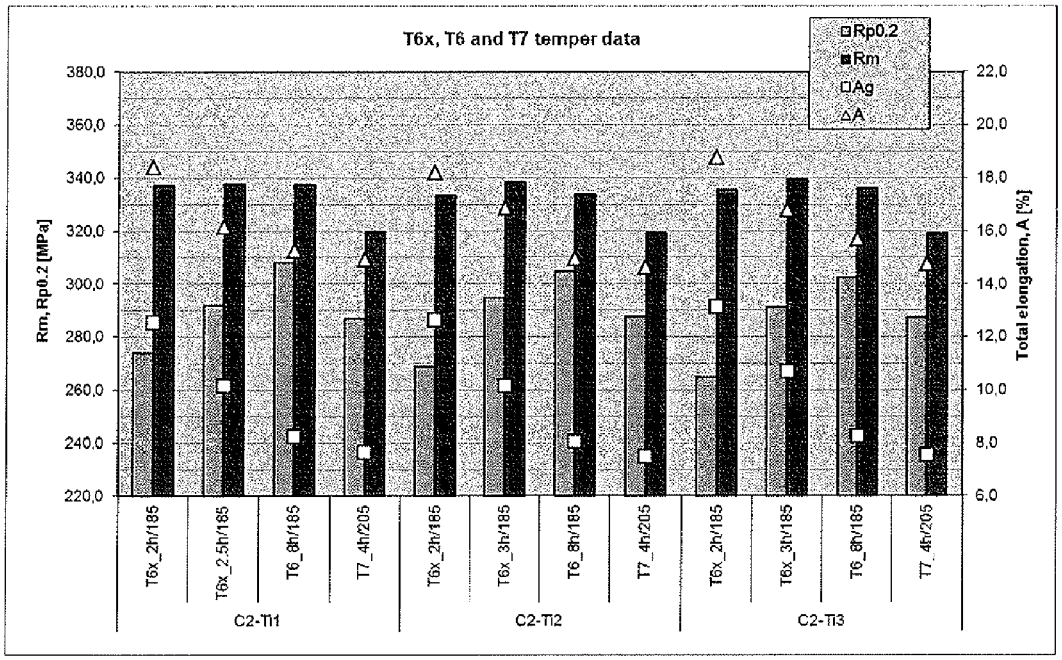

FIG. 20 shows Mg—Si windows and tested alloy compositions for both the $1^{st}$ and a $2^{nd}$ test series related to the present invention, FIG. 21 is a bar diagram showing the mechanical properties of alloys $2^{nd}$ series tested alloys a1-a4, FIG. 22 is a further bar diagram showing the mechanical properties of alloys c1-c4 of the second series tests plus the "Honsel" alloy with higher Mg/Si ratio, FIG. 23 Is a still further bar diagram showing the mechanical properties of alloys X1 with different Cu contents, FIG. 24 Is a bar diagram showing the mechanical properties of alloys C2 with different Cu contents, FIG. 25 Is another bar diagram showing the mechanical properties of alloys X1 with different Ti contents, FIG. 26 Is still another bar diagram showing the mechanical properties of alloys C2 with different Ti contents.

Figure 27:
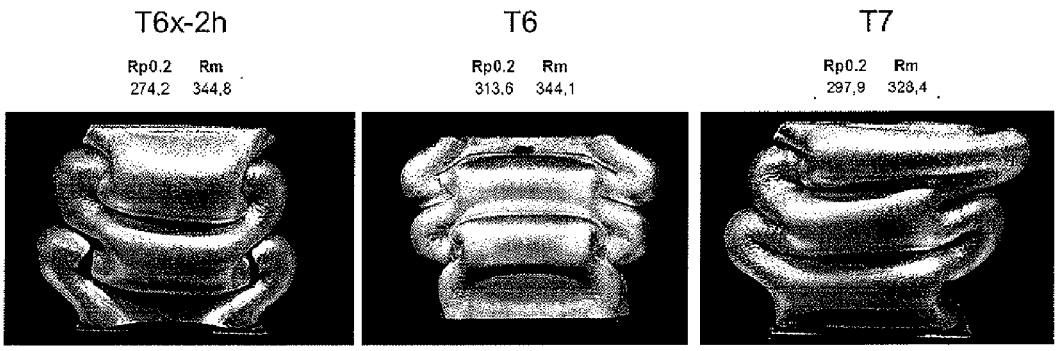
Figure 28:
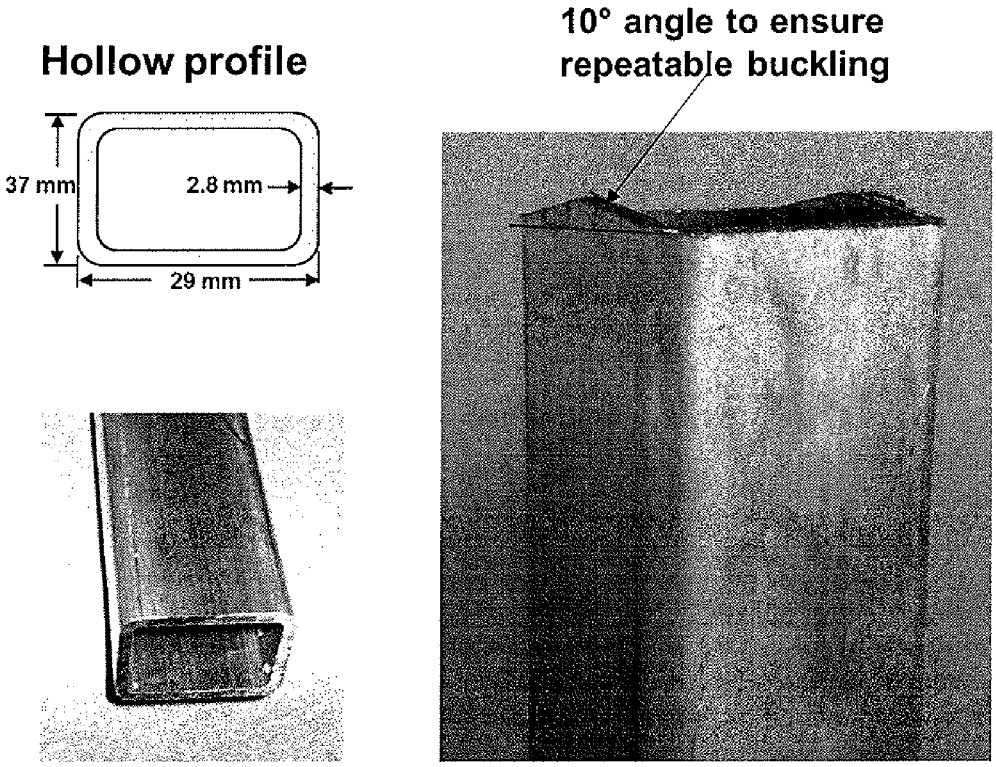
Figure 29:
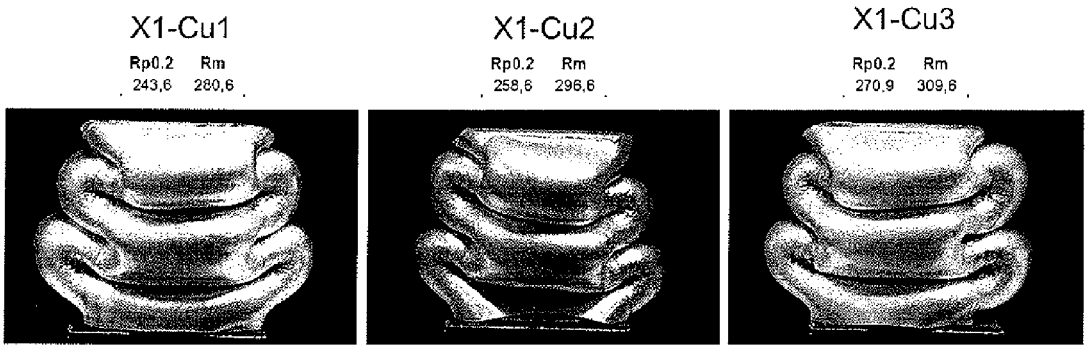

FIG. 27 shows examples of photos of taken of crush tested specimen of the type shown in FIG. 28, FIG. 28 shows specimen used for crush testing of additional $3^{rd}$ series alloys, FIG. 29 are photos of crush tested specimens of Cu alloys showing the crush behaviour of the different alloy variants in a T7 condition.

The inventors found through their studies of Al—Mg—Si alloys in connection with the present invention that:

- The temperature stability improves with increasing Mg/Si ratio and increasing Cu content.
- The strength of an Al—Mg—Si alloy increases with reduced Mg/Si ratio.
- The strength increases and the crush behaviour is maintained with an increasing Cu content.
- Ti improves the corrosion resistance and probably also the crush behaviour.
- That an overaged condition (T7) performs better in a crush test than an underaged condition (T6x) at the same yield strength levels.
- There are obvious benefits of using non-recrystallised vs. recrystallised structures on crush and corrosion behaviour.

As to the latter, the alloying elements Mn, Cr and Zr produce dispersoid particles during the homogenising process. The particles are precipitated during the heat up stage and grow and coarsen during soaking at the holding temperature. Mn and Cr both form dispersoid particles together with Al, Si and Fe whereas Zr forms dispersoid particles together with Al alone if the Si content is low and together with Al and Si for higher Si contents as in the present alloys. The number density of particles depends on the amount of alloying elements, the homogenising temperature and the holding time.

In order to obtain a non-recrystallised grain structure in the extruded profile a certain number density of dispersoid particles is required. This required number density depends on the profile shape, the billet temperature, the extrusion speed and on the allowable recrystallised layer in the surface region of the extruded profile. For a thick profile, low extrusion speed and if a fairly thick recrystallised layer of grains is allowed the number density of dispersoid particles can be rather low. For a thin walled hollow profile and with a maximum possible extrusion speed and almost no recrystallised layer allowed, the number density of dispersoid particles needs to be much higher.

As explained above a high number density of dispersoids can be obtained by one of the three mentioned alloying elements alone, but a combination of two or more elements can be beneficial in order to obtain a good distribution of the dispersoid particles. The number density is also determined by the homogenisation temperature. A low temperature promotes a high number density whereas a high temperature gives a lower number density of dispersoid particles. The number density of dispersoid particles will be reduced with increased holding time at temperature. Thus, a short time at a homogenising temperature in the lower range gives the highest number density of dispersoid particles for a given addition of dispersoid forming alloying elements.

The lowest number density of dispersoid particles that produces a mainly non recrystallised structure and an acceptable crush performance would be ideal. Any excess dispersoid particles are not necessary and not wanted. The reason for this is that the dispersoid particles are causing the deformation resistance to increase, giving a lower maximum extrusion speed and lower productivity as a result. Therefore one would like to balance the number of dispersoid particles. The choice of homogenising parameters would be based on the number density of dispersoid particles needed, the levelling out of the concentration gradients of alloying elements like Mg, Si and Cu and on the spherodising and breaking up of primary Fe-containing particles formed during casting.

Any holding temperatures between 530 and 590° C. would be possible. Below 530° C. the Mg and Si in the alloy will not dissolve completely and large $Mg_2Si$ particles will be present in the billet. Above 590° C. there is a considerable risk of getting excessive melting in the inverse segregation zone in the billet (enriched outer layer in the billet formed during the casting process). For example with only Mn additions (as the dispersoid forming element) and being towards the lower end of the alloy window one would need to use a low homogenising temperature in order to produce a number density of dispersoid particles that is high enough to avoid recrystallisation during extrusion. At this low temperature the spherodising of the primary particles will be very slow. Therefore, a higher amount of dispersoid forming elements in combination with somewhat higher homogenising temperatures would be beneficial. Additions of Mn and Cr together and homogenising temperatures between 540 and 580° C. seem to give the best distribution of dispersoid particles, the necessary number density of dispersoid particles and an acceptable sperodisation of primary particles. The time at the homogenisation temperature would typically be between 2 and 10 hours.

The present invention is as stated above related to an extrudable Al—Mg—Si aluminium alloy with improved strength, corrosion resistance, crush properties and temperature stability, and which in particular is useful in the front structure of vehicles.

The composition of the inventive alloy is defined within the following coordinate points of an Mg—Si diagram:

a1-a2-a3-a4, where in wt % a1=0.60Mg, 0.65Si, a2=0.90Mg, 1.0Si, a3=1.05Mg, 0.75Si and a4=0.70Mg, 0.50Si and where the alloy has a non-recrystallised grain structure in the extruded profile containing in addition the following alloy components in wt %:

Fe up to 0.30

Cu 0.1-0.4

Mn 0.4-1.0
Cr up to 0.25
Zr up to 0.25
Ti 0.005-0.15 and
incidental impurities up to 0.1 each and including Zn up to 0.5 with balance Al.

Figure 1:
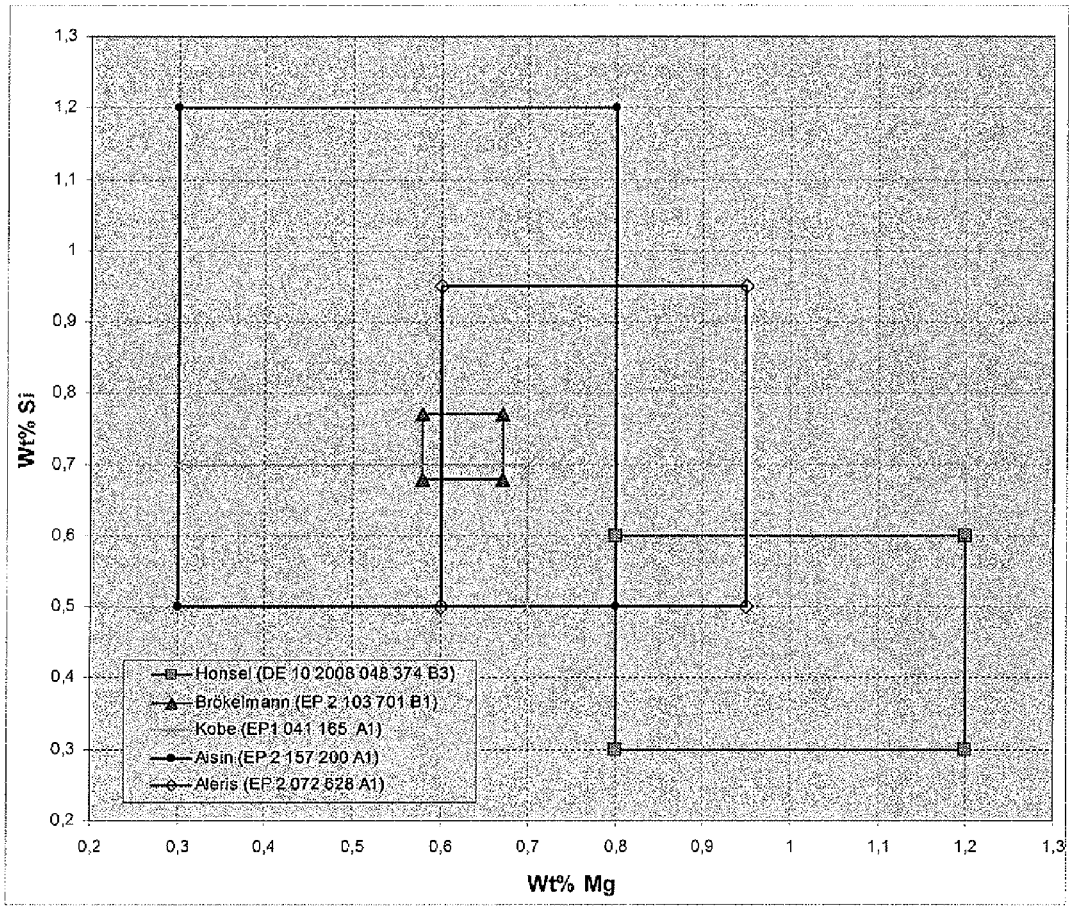
FIG. 1 is a diagram showing the Mg and Si contents of some Al—Mg—Si alloys described in the prior art patent applications commented in the initial part of the present application.

FIG. 1 is a diagram showing the Mg and Si contents of some Al—Mg—Si alloys described in the prior art patent applications commented initially, in the special part of the present application.

Figure 2:
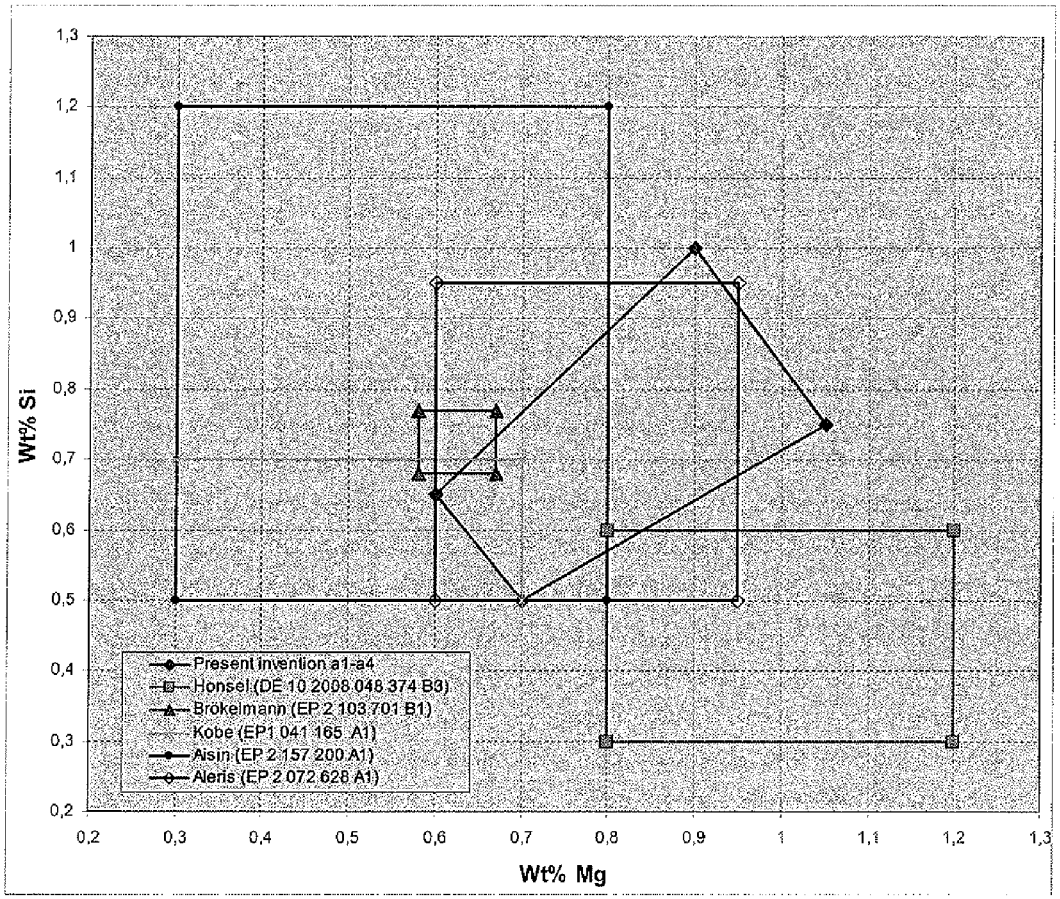
FIG. 2 shows the same diagram, but also depicts the Mg and Si window according to claim 1 of the present invention.

FIG. 2 shows the same diagram, but with where the Mg and Si window according to the present invention is depicted and which is defined with the co-ordinates a1, a2, a3, a4 as indicated above.

Figure 3:
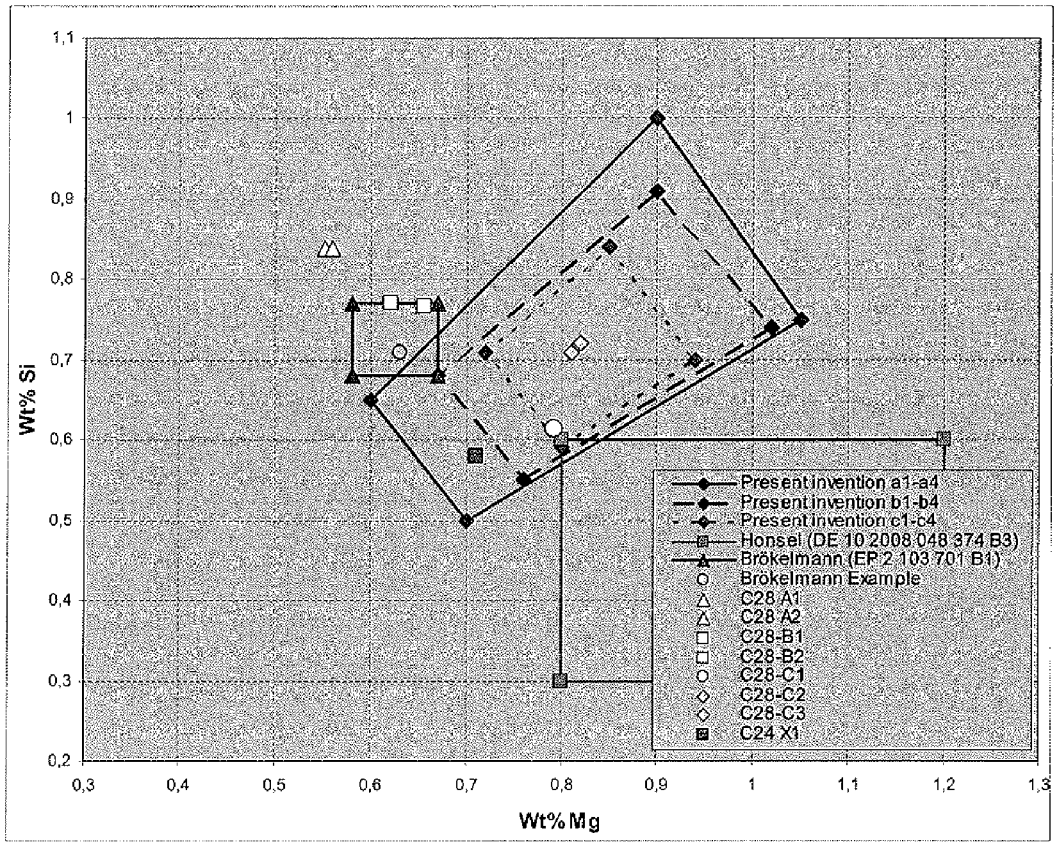
FIG. 3 shows preferred embodiments of the invention in the form of narrower Mg—Si windows b1-b4 and c1-c4 and Mg—Si contents of some of the investigated alloys as well as prior art alloys described by Honsel and Brökelmann.

The lower part (lowest sum of Mg and Si) of the Mg and Si window as defined by the coordinates a1, a2, a3 and a4 covers a C24 alloy whereas the upper part covers a possible future C32 alloy. This Mg—Si window defines the outer limits of the present inventive alloy. It should be noted that this window is outside of the example shown in the Brökelmann patent. Preferred embodiments of the invention are further shown as Mg—Si windows b1-b4 and c1-c4 in FIG. 3. The narrowest Mg—Si window only includes alloys meeting the C28 requirements.

1st Test Series.

In the first test series a total of 6 different alloys according to the invention were tested. The alloys were cast as Ø0203 mm logs. The alloy compositions are shown in Table 1 below. All 5 alloys labelled C28 will all give a non-recrystallised structure in the extruded profile due to the high amount of the dispersoid forming elements Mn and Cr. The dispersoids, which as formerly stated are formed during the homogenisation heat treatment, act as barriers against movement of dislocations and grain boundaries. If the number density of dispersoids is high enough the deformation structure formed during extrusion will be preserved. Typically, one often observes a recrystallised layer in the surface of an extruded profile because of the very high deformation rates in this region. The thickness of the recrystallised layer will increase as the number density of dispersoid particles is reduced. An uneven distribution of the dispersoid particles will probably give a similar result as a lower number density. For comparison of the crush behaviour a standard 6061 alloy was included. This alloy typically produces a recrystallised grain structure in the extruded profile.

The homogenisation cycle was as follows: Heating by approximately 200° C. up to 575° C.; 2 hours and 15 minutes holding time at 575° C. and cooling by approximately 400° C./hour to a temperature below 200° C.

TABLE 1

Alloy compositions of the first alloy series of C28 alloys that were tested.

| Alloy name | Mg | Si | Fe | Cu | Mn | Cr | Ti |
|---|---|---|---|---|---|---|---|
| C28-A1 | 0.55 | 0.84 | 0.18 | 0.27 | 0.50 | 0.15 | 0.01 |
| C28-A2 | 0.56 | 0.84 | 0.18 | 0.18 | 0.49 | 0.15 | 0.01 |
| C28-B1 | 0.62 | 0.78 | 0.22 | 0.24 | 0.66 | 0.00 | 0.01 |
| C28-B2 | 0.66 | 0.77 | 0.21 | 0.24 | 0.52 | 0.17 | 0.01 |
| C28-C1 | 0.79 | 0.61 | 0.19 | 0.25 | 0.52 | 0.15 | 0.01 |
| 6061-B | 0.65 | 0.89 | 0.26 | 0.25 | 0.01 | 0.06 | 0.01 |

Included in the first series of tests an additional number of alloys were produced for further testing, see Table 2. Two alloys similar to the C1 alloy, but with slightly higher Mg and Si contents were included in this series. This was done because the C1 alloy was slightly too low in tensile properties in order to meet the C28 requirement of Rp0.2>280 MPa. Also included in this series was a C24 alloy named C24-X1, which was intended to meet the minimum C24 requirement of Rp0.2>240 MPa.

TABLE 2

Alloy compositions of the additional alloys that were tested. This includes two C28 alloys and one C24 alloy.

| Alloy name | Mg | Si | Fe | Cu | Mn | Cr | Ti |
|---|---|---|---|---|---|---|---|
| C28-C2 | 0.81 | 0.71 | 0.20 | 0.24 | 0.52 | 0.16 | 0.02 |
| C28-C3 | 0.82 | 0.72 | 0.21 | 0.24 | 0.53 | 0.17 | 0.10 |
| C24 X1 | 0.71 | 0.58 | 0.19 | 0.18 | 0.53 | 0.15 | 0.01 |

Figure 4:
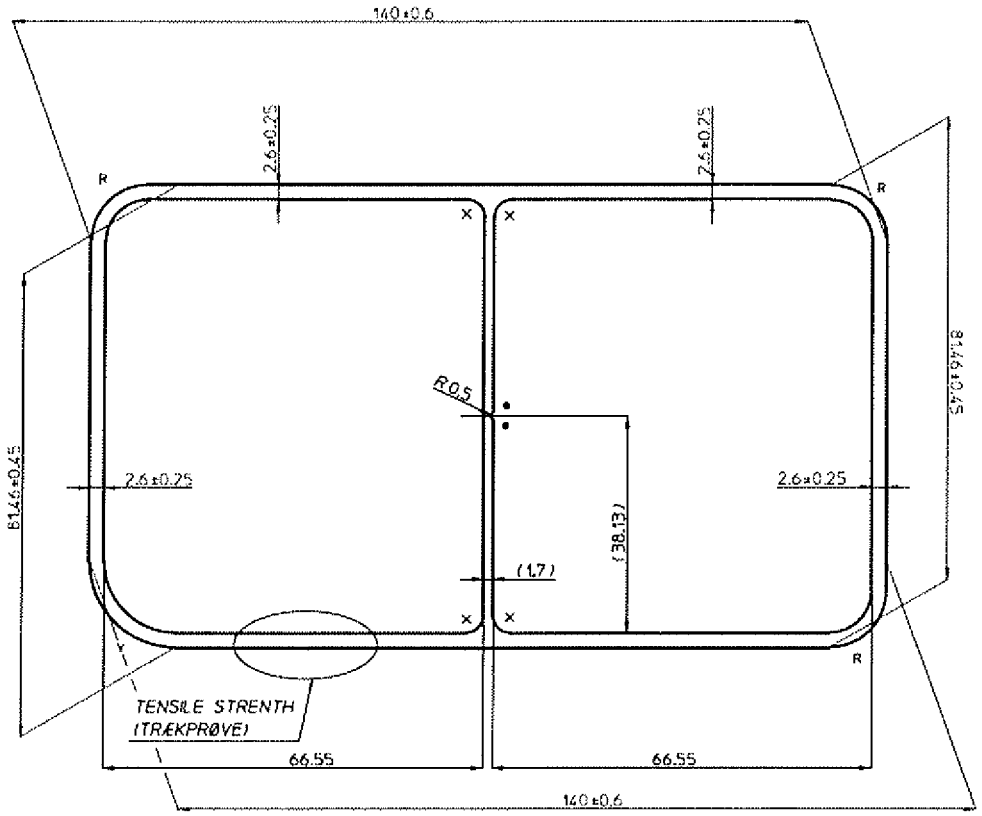
FIG. 4 shows a cross section of the profiles extruded from the different alloys included in Tables 1 and 2 and in FIG. 3.

The billets were extruded in an industrial extrusion press to a profile with a cross section shown in FIG. 4. The billets were preheated in an induction furnace to a temperature around 500° C. After extrusion the profiles were water quenched by a quench box located about 1 m behind the press opening. The profiles were then stretched approximately 0.5% before the profiles were cut. All profiles were stored for several days and in some cases weeks before ageing.

Figure 5:
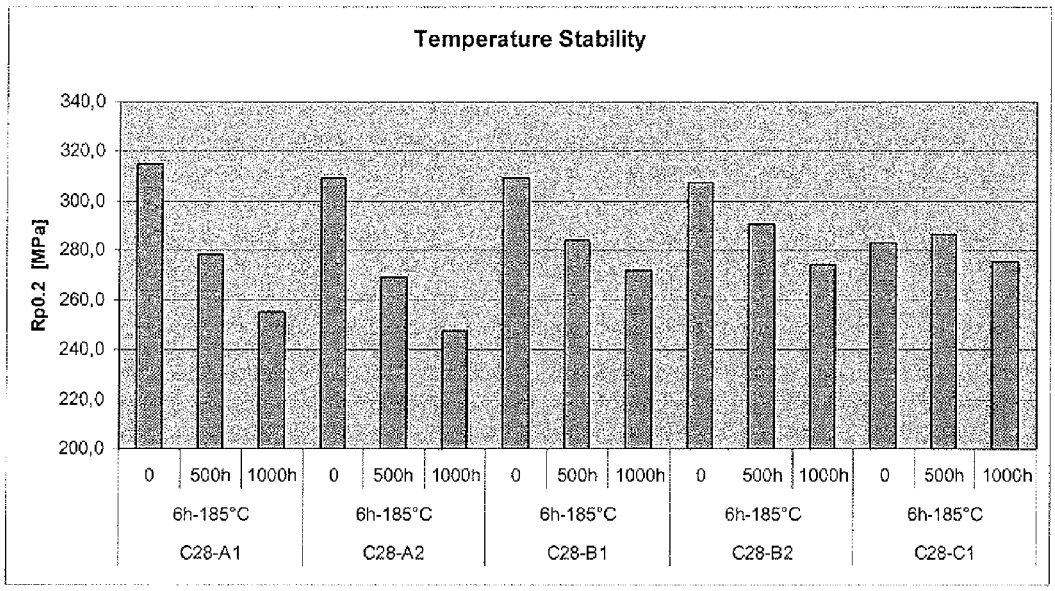
FIG. 5 shows Rp0.2 after tensile testing for the different alloys in series 1 of the tests where the digits 0, 500 and 1000 indicate the number of hours of temperature exposure at 150° C. after the ageing cycle of 6 hours at 185° C.

FIG. 5 shows the Rp0.2 after ageing at 185° C. for 6 hours and after different times of temperature exposure at 150° C. for the different alloys in series 1. By comparing alloys A1 and A2 one can observe that the temperature stability increases slightly with an increase in Cu content. By comparing the A, B and C alloys one can observe that the strength loss upon temperature exposure decreases dramatically with increasing Mg/Si ratio. After an initial ageing cycle of 6 hours at 185° C. alloys B1 and B2 meet the requirement on temperature stability, which is 265 MPa after 1000 hours at 150° C. Alloy Cl show a much lower strength after the initial ageing cycle at 185° C., but seems to be almost unaffected by the temperature exposure at 150° C.

Figure 6:
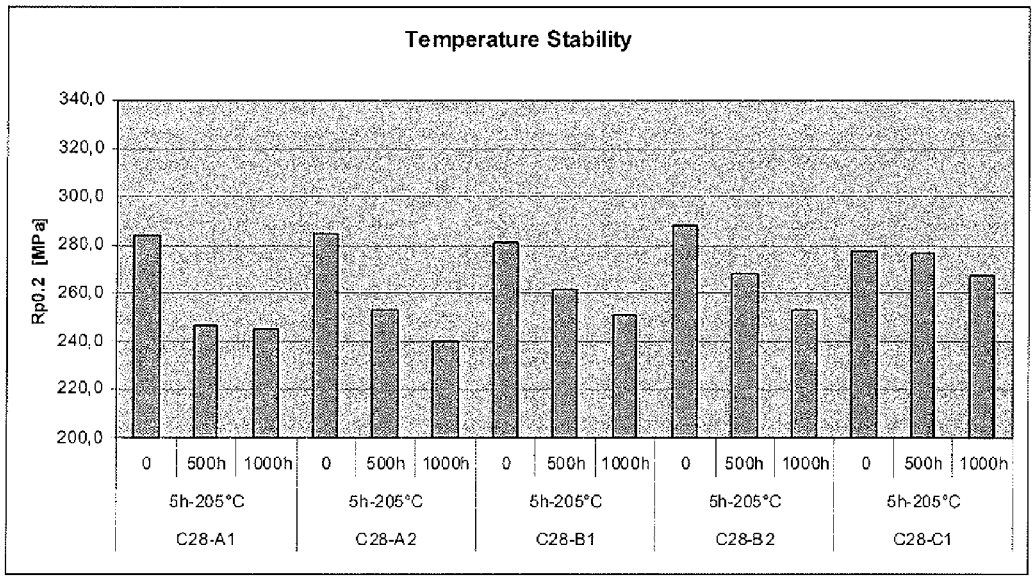
FIG. 6 shows Rp0.2 after tensile testing for the different alloys in series 1 where the digits 0, 500 and 1000 indicate the number of hours of temperature exposure at 150° C. after the ageing cycle of 5 hours at 205° C.
Figure 7:
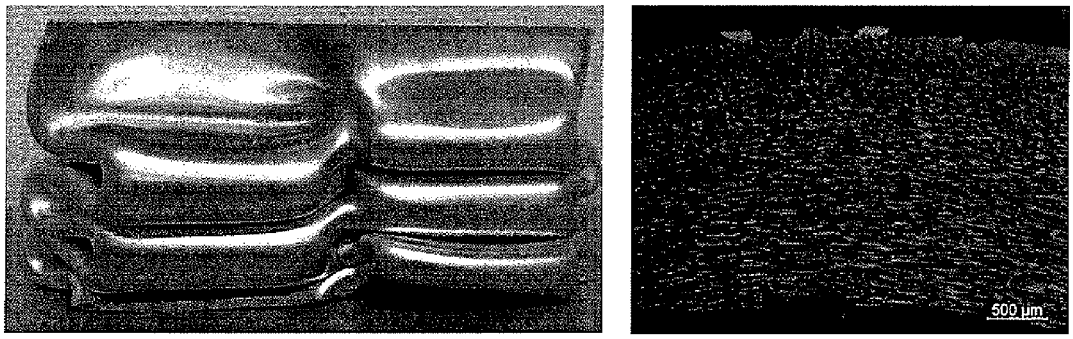
FIG. 7 shows a crushed sample of alloy A1 with the corresponding grain structure in a cross section of the profile (Rp0.2=284 MPa).
Figure 8:
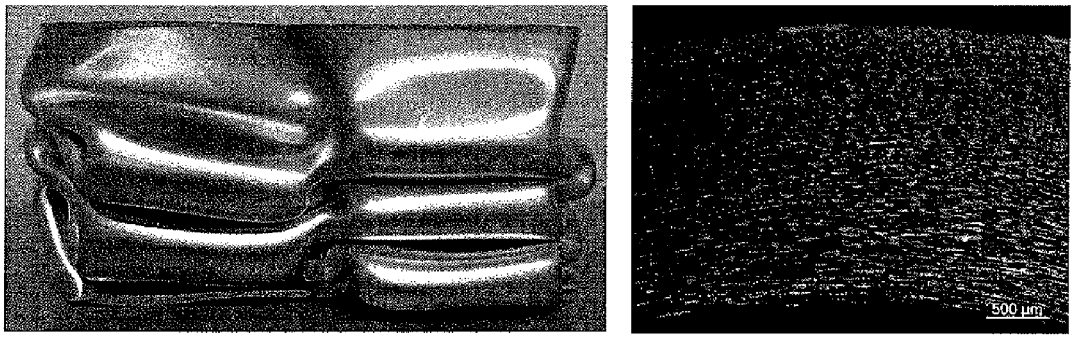
FIG. 8 shows a crushed sample of alloy A2 with the corresponding grain structure in a cross section of the profile (Rp0.2=284 MPa).

Generally, ductility and crush performance are reduced as the strength of an alloy increases. Therefore it is recommended to either make an alloy that just meets the requirement in a T6 condition or to overage an alloy with a higher strength potential to a strength which is just above the requirement. Overageing was done by the example shown in FIG. 6, where all the alloys were aged 5 hours at 205° C. Except for alloy Cl which had an Rp0.2 value just below the requirement of 280 MPa, all the other alloys had Rp0.2 values just above the requirement. With this as the starting point only alloy C28-C1 met the requirement of minimum Rp0.2 of 265 MPa after the temperature exposure of 1000 hours at 150° C.

This shows that the optimum Mg/Si ratio is slightly higher than for the C28-B1 and C28-B2 alloys with respect to the demands on temperature stability. In the other end the Mg/Si ratio should not be much higher than for alloy C28-C1 because the mechanical properties then will be too low to meet the C28 requirement. The optimum Mg/Si ratio is found in the area defined by the a1-a4 as shown in FIG. 2.

In FIGS. 7 to 12 pictures of crushed profiles are shown along with the grain structure in a cross section of the profile. A drawing of the cross section of the profile is shown in FIG. 4. The profiles were deformed by axial crushing; starting with a straight profile of 200 mm and ending up with a crushed profile of 67 mm.

Figure 9:
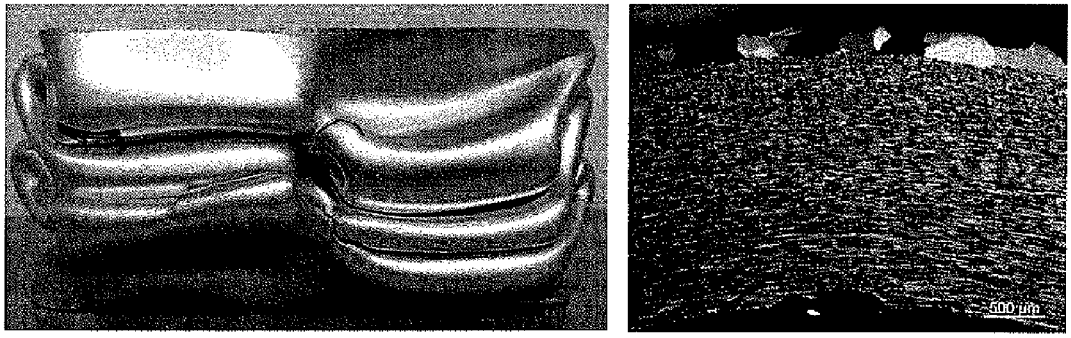
FIG. 9 shows a crushed sample of alloy B1 with the corresponding grain structure in a cross section of the profile (Rp0.2=281 MPa).
Figure 12:
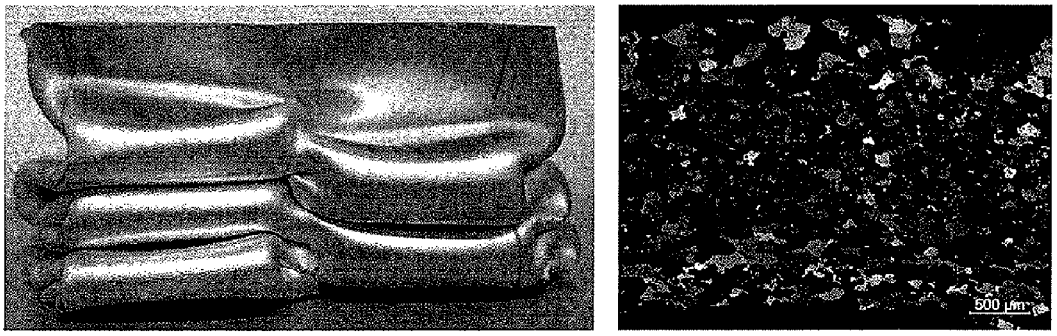
FIG. 12 shows a crushed sample of alloy 6061 with the corresponding grain structure in a cross section of the profile (Rp0.2=288 MPa).

Except for the C28-B1 sample in FIG. 9 and the 6061 sample in FIG. 12 all the other alloys show acceptable crush behaviour. A few small cracks in a T-joint are accepted but cracks in the folds, as shown for alloys C28-B1 and 6061 cannot be accepted.

Figure 10:
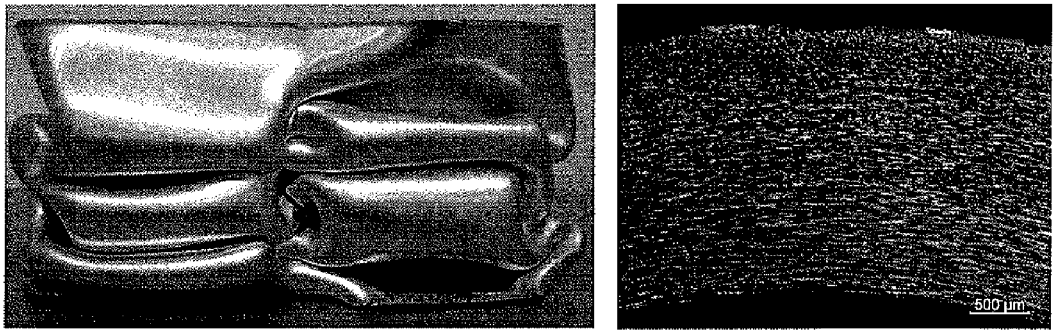
FIG. 10 shows a crushed sample of alloy B2 with the corresponding grain structure in a cross section of the profile (Rp0.2=289 MPa).
Figure 11:
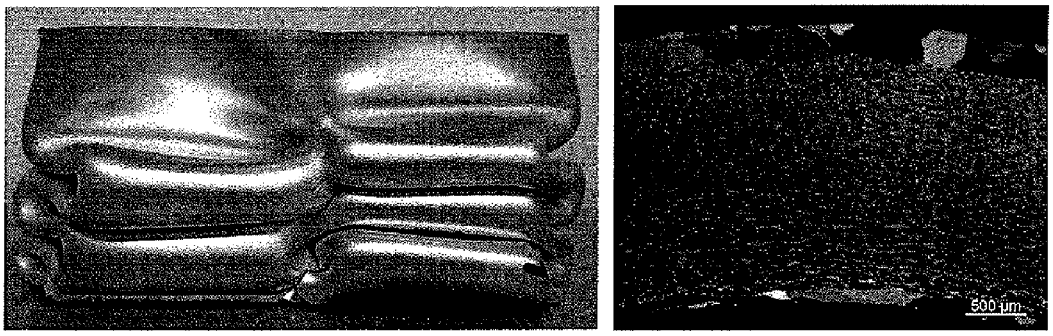
FIG. 11 shows a crushed sample of alloy C1 with the corresponding grain structure in a cross section of the profile (Rp0.2=277 MPa).

The reason why C28-B1 is inferior to C28-B2 with respect to crush behaviour could be due to the relatively coarse recrystallised surface layer seen in the micrograph in FIG. 9 which is absent in FIG. 10. However, the recrystallised surface layer for alloy C28-C1 (FIG. 11) is similar to C28-B1 (FIG. 9) so the coarse recrystallised surface layer cannot be the only explanation for the difference. One difference between the C28-B1 alloy and the other C28 alloys is the absence of Chromium (Cr) in alloy C28-B1. It is known that Cr solidifies in aluminium in a peritectic reaction (among the first material that solidifies). In the cast billets the highest concentration of Cr will be in the interior of the grains. Mn solidifies in aluminium in a eutectic reaction (among the last material that solidifies). The highest concentration of Mn will therefore be towards the grain boundaries in the cast structure of the billet. In the extruded profile these grains will be stretched out in the extrusion direction. An even distribution of dispersoid particles in the billet will give a more even distribution also in the extruded profile. Therefore, additions of both Cr and Mn will give a better distribution of dispersoid particles than additions of Mn or Cr alone. An even distribution of dispersoid particles could in itself produce a more even distribution of the deformation and not only through the resulting grain structure. Thus, the reason for the inferior behaviour of alloy C28-B1 could be the lack of Cr and therefore a more uneven distribution of dispersoid particles.

Alloy 6061 produces a recrystallised structure in the extruded profile due to the low amount of dispersoid forming elements (no Mn and 0.06 wt % Cr). The 6061 alloy had a similar Rp0.2 value as the different C28 alloys in this investigation, but the crush behaviour seems to be inferior. This difference in behaviour can either be a result of the difference in grain structure or it could be due to a much lower number density of dispersoid particles in this alloy. The lower number of dispersoids may not distribute the deformation as well as for the variants with a high number of dispersoids.

Because the most promising variant with respect to temperature stability, C28-C1 gave slightly too low Rp0.2 values a new variant C28-C2 was cast. The alloy composition of this variant is given in Table 2. Also included in this series of alloys are; one alloy C28-C3, which has a Ti (Titanium) content of 0.10 wt % as compared to 0.02 wt % in alloy C28-C2; and a C24-X1 alloy which is similar to the C28-C1 with respect to Mg/Si ratio but has slightly lower contents of Mg, Si and Cu.

Figure 13:
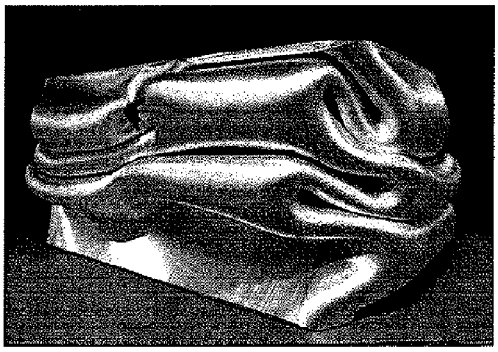
FIG. 13 shows crushed sample of alloy C28-C2 (Rp0.2=285 MPa).
Figure 14:
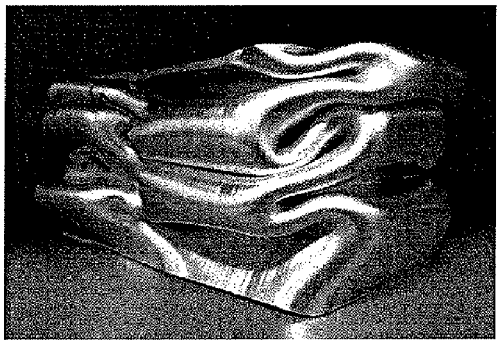
FIG. 14 shows a crushed sample of alloy C28-C3 (Rp0.2=281 MPa).

FIGS. 13 and 14 show crushed profiles of alloys C28-C2 and C28-C3, respectively. The crush behaviour of both samples is rated to be okay, but the sample with Ti (FIG. 14) is rated slightly better than the one without Ti.

Figure 15:
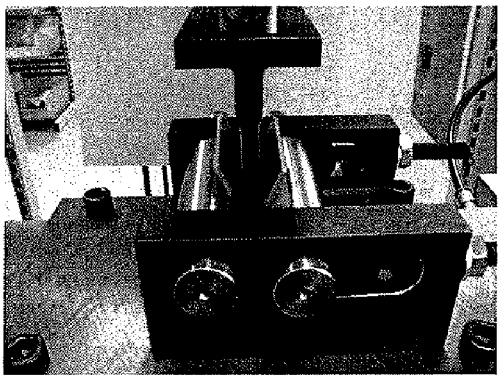
FIG. 15 shows equipment and setup for evaluating bending behaviour of different materials.
Figure 15:
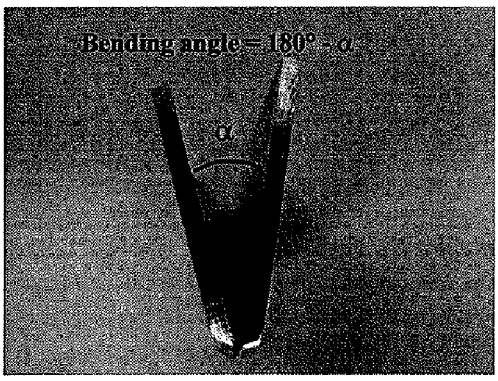

These two alloys were also rated by a bending test that was performed for both alloys. The equipment and setup for the bending test are shown in FIG. 15. The bending test has been developed by the car producer Daimler. The bending angle is defined by the observation of the first crack, which is also clearly seen in a force displacement curve. The sample is a flat part of the profile that is bent along an axis 90° in relation to the extrusion direction (i.e. normal to the extrusion direction). The measured bending angle is the angle where the first crack is observed in the sample. This can bee seen on the sample after testing, but is first recorded by a drop in the force displacement curve recorded during testing. The bending test is then stopped and the bending angle measured. The result from the test is given in Table 3 and shows that alloy C28-C3 could be bent to a larger angle than alloy C28-C2 before the first crack was observed. This indicates that an alloy with Ti is more ductile than an alloy without.

It is known that Ti solidifies in aluminium in a peritectic reaction and is therefore in the part of the material that solidifies first, i.e. in the interior of the grains. Ti in the amounts added in alloy C28-C3 does not appear to a large extent in any primary or secondary particles, and most of the Ti seems to be in solid solution.

After extrusion the Ti will be located in bands that originally were the interior of the cast grains in the billet. These bands will be stretched out in the extruded profile as oblong pancakes. In a crush test Ti may work in a similar way as Cr and Mn by evening out the deformation and therefore contribute to larger resistance against cracking.

TABLE 3

Observed bend angle for the first appearance of cracks for the two alloys C28-C2 and C28-C3.

| Alloy | Bend Angle |
|---|---|
| C28-C2 | 131° |
| C28-C3 | 145° |

Corrosion Resistance.

Different OEMs have different requirements on corrosion resistance. With the present invention an aggressive intergranular corrosion (IGC) test has been chosen in order to rank different alloys rather than finding alloys that meet the specific requirements of each of the different OEMs. The chosen intergranular corrosion test was performed according to BS ISO 11846:1995 standard, which includes the following:

Before testing the samples were degreased with acetone.

The samples then were immersed for 2 min in 5 wt % sodium hydroxide solution at a temperature of 60° C., washed in running water, immersed for 2 min in concentrated nitric acid for de-smutting, rinsed in running water and then in deionised water and dried.

The samples were then immersed for 24 h in a solution containing 30 g/l sodium chloride and 10 ml/l of concentrated hydrochloric acid at room temperature.

After testing, the samples were rinsed in running water and then in deionised water and were allowed to dry prior to the metallographic examinations.

Maximum corrosion depths were measured from the outer part of the profile samples.

Figure 16:
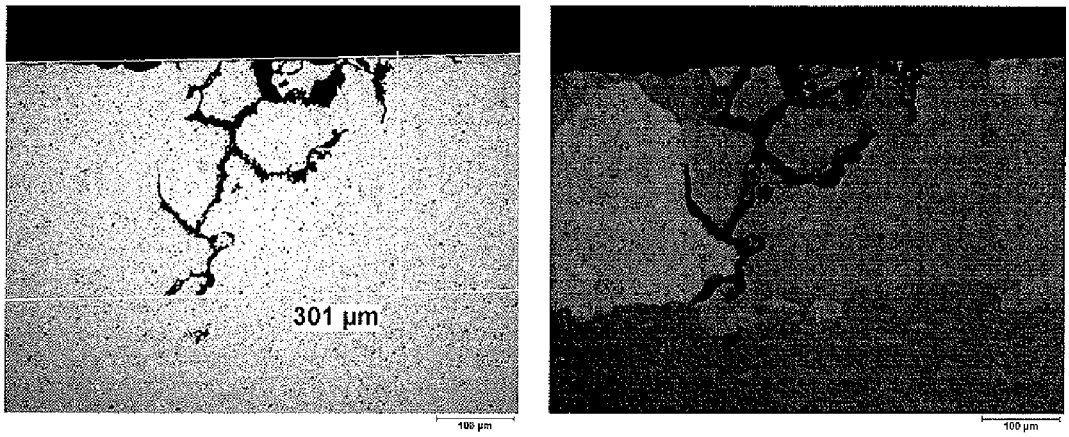
FIG. 16 shows two pictures of a cross section taken (close to the surface) from an extruded profile of alloy C28-C2 after a 24 h IGC corrosion test. Both pictures show the same area of the sample, with the left picture showing the corrosion attack depth and the right picture showing the grain structure after anodising the sample.

FIG. 16 shows two pictures of the cross section close to the surface of an extruded profile of alloy C28-C2 after a 24 h IGC corrosion test and where both pictures show the same area of the sample, but where the right picture shows the corrosion attacks together with grain structure in the same sample after anodising.

Figure 17:
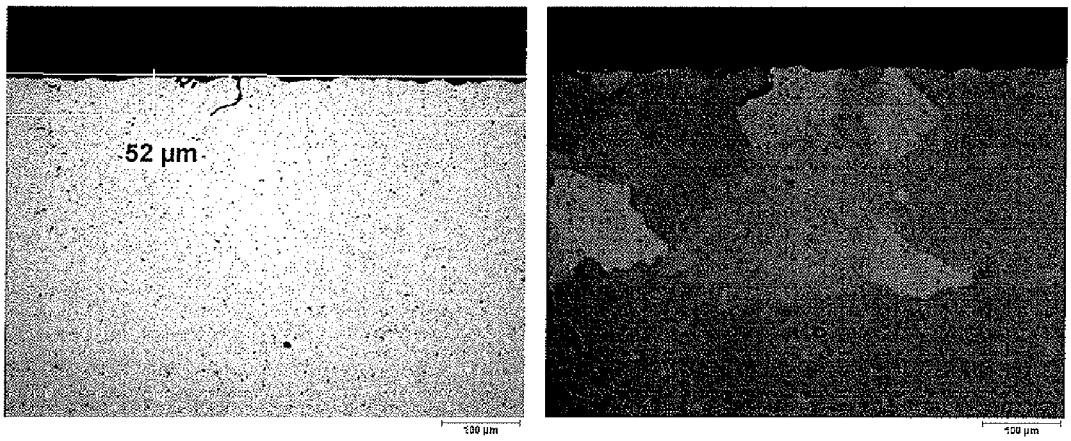
FIG. 17 shows two pictures of a cross section taken (close to the surface) from an extruded profile of alloy C28-C3 after a 24 h IGC corrosion test. Both pictures show the same area of the sample, with the left picture showing the corrosion attack depth and the right picture showing the grain structure after anodising the sample.

Further, FIG. 17 shows as well two pictures of the cross section close to the surface of an extruded profile of alloy C28-C3 after a 24 h IGC corrosion test. Both pictures show the same area of the sample but the right picture shows the attacks together with grain structure after anodising.

As can bee seen in FIGS. 16 and 17 the maximum corrosion attack is much smaller for the C28-C3 alloy, indicating that there is a significant positive effect of adding 0.10 wt % Ti on the corrosion resistance. The mechanism of this effect is not known.

Ageing.

Generally speaking, artificial ageing of 6xxx aluminium alloy material is performed in order to precipitate hardening particles of Mg, Si and Cu. These particles are typically needle shaped with a diameter of 2-20 nanometers and a length of 20-200 nanometers. The particles may have different chemical compositions and crystal structures depending on the overall composition of the alloy and the ageing temperatures and times involved.

At the start of the ageing cycle the particles are typically coherent with the aluminium structure surrounding the particle. At this stage (underaged condition, T6x) the particles will be shared by dislocations during deformation of the material. Later in the ageing cycle the fit between the aluminium structure and the particles is gradually reduced and the particles become partly or fully incoherent. At this stage (peak age, T6, or overaged condition, T7) the dislocations formed during deformation will not shear the particles due to the incoherency at the particle interface.

In the case of an underaged condition, T6x, there is a tendency for the deformation to be concentrated along slip planes already formed by the first dislocation. This situation may lead to very concentrated deformation in some parts of the material with cracks as the result. This situation will give low ductility of the material. In the case of overageing, T7, the dislocations have to pass the particles by another mechanism called Orowan looping. In this case the first dislocation that has passed a particle will form a dislocation loop around the particle that will act as an extra barrier against the next dislocation. This may in turn activate other slip planes for dislocations and therefore spread the deformation to other parts of the material. In this case the material can withstand larger total deformations before any cracks will appear and the material will be more ductile.

Figure 18:
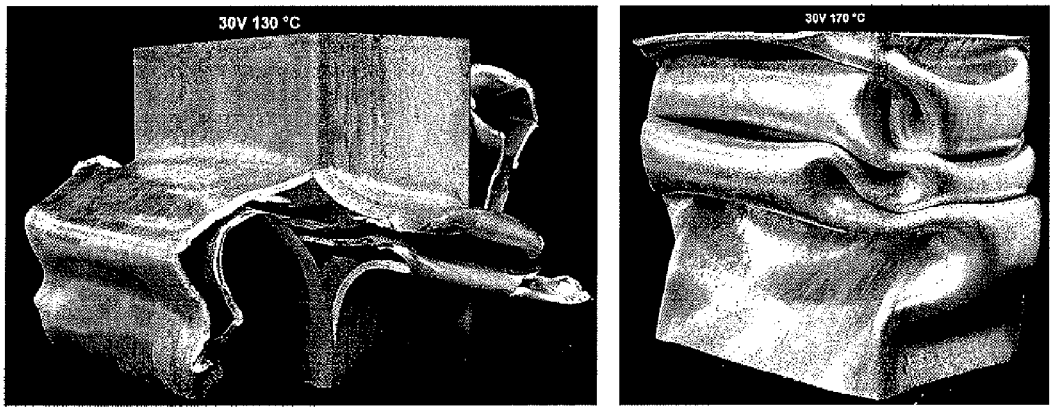
FIG. 18 shows pictures of crushed samples of a 7003 alloy where to the left is shown a sample in underaged condition with Rp0.2=294 MPa (T6x—Ageing for 8 hours at 130° C.)

The case where the dislocations are shearing the particles when the material is aged to an underaged condition, T6x, is seen very clearly for 7xxx alloys as the one shown in FIG. 18 containing Mg=0.69 wt %; Zn=5.51 wt %; Fe=0.21 wt %; Zr=0.14 wt %; Si=0.10 wt %; Mn=0.05 wt %. The left picture in FIG. 18 shows a crushed sample of said 7003 alloy aged to an underaged condition, T6x, whereas the right picture shows a crushed sample of the same alloy aged to an overaged condition, T7. This clearly demonstrates that in this case an overaged condition is much more ductile than an underaged condition when the yield strength values, Rp0.2 are similar.

For 6xxx alloys of the type according to the invention the difference in ductility between an underaged, T6x and an overaged, T7 condition is not as large as for 7xxx alloys, but also in this case the overaged condition seems to be better than an underaged condition. This was clearly demonstrated in the second test series discussed later in the description. One such example is shown in FIG. 27, where the T6x sample with lower yield strength has more cracks than the samples in the T7 condition. Another beneficial factor is that it is easier to control the yield strength level in the overaged condition than in the underaged condition.

FIG. 19 shows pictures of crushed samples of alloy C28-B2 according to the invention where the left picture shows a sample in overaged condition with Rp0.2=289 MPa (T7—ageing for 5 hours at 205° C.) and to the right a sample in peak strength condition with Rp0.2=303 MPa (T6—Ageing for 6 hours at 185° C.). As can be seen by the clearly visible cracks for the right sample in FIG. 19, which is in T6 condition, the crush behaviour of the left sample, which is in overaged T7 condition with slightly lower yield strength, is better.

The alloy according the present invention may be overaged at a temperature between 185-215° C. for a time between 1-25 hours. More preferably the alloy may be overaged at a temperature between 200-210° C. for a time between 2-8 hours.

$2^{rd}$ Test Series.

In order to strengthen the patent application a series of new, additional alloys were tested. The alloys were cast to ø95 mm billets and homogenised at 575° C. for 2 hours and 15 minutes followed by cooling at 400° C./hour The billets were then extruded at 8 m/min to a rectangular hollow profile (see FIG. 28) in an 800 ton extrusion press at the independent research organization, Sintef in Trondheim.

- Prior to extrusion the billets were preheated by an overheating process: I.e. heated to 550° C.; held at temperature for approximately 10 minutes; quenched to approximately 500° C. just before extrusion.
- After extrusion the profiles were quenched in water approximately 0.8 m behind the die opening.
- The profiles were stored at room temperature for several weeks before ageing to different conditions. In all cases the samples were heated to temperature with a heating rate of 200° C. per hour.
  - T6x. Under-aged condition. It was aimed at obtaining the same yield strength value, Rp0.2, as for the T7 condition. First a 2 hours hold at 185° C. was used for all alloys. Because the T6x Rp0.2 values in many cases missed the T7 Rp0.2 values new samples were produced. These were aged with holding times of 2.5 or 3 hours.
  - T6: Peak aged condition. 8 hours holding time at 185° C.
  - T7: Over-aged condition. 4 hours at 205° C.
- After ageing tensile samples were machined from the widest sides of the profile. Crush samples were 100 mm long and cut with a pyramid on each of the short sides (See FIG. 28) to make the crush behaviour more repeatable (act as a trigger for the first buckle)

All of the alloys of the $2^{nd}$ alloy series were crush tested with specimen as shown in FIG. 28, and photos corresponding to the photos as shown in FIG. 27 were taken of all of the crush tested specimen. However, these are not included in the application due to the comprehensive required space (number of photos) except the three photos of crush tested specimens of Cu alloys in FIG. 29 which are further discussed on page 20 of the description.

Table 4 below shows the different alloys with different Mg—Si levels:

| Alloy | Mg | Si | Fe | Cu | Mn | Cr | Ti |
|---|---|---|---|---|---|---|---|
| a1 | 0.586 | 0.621 | 0.174 | 0.225 | 0.505 | 0.162 | 0.023 |
| a2 | 0.676 | 0.505 | 0.184 | 0.230 | 0.513 | 0.162 | 0.014 |
| a3 | 0.985 | 0.760 | 0.193 | 0.232 | 0.520 | 0.161 | 0.019 |
| a4 | 0.843 | 0.933 | 0.179 | 0.222 | 0.517 | 0.163 | 0.014 |
| c1 | 0.762 | 0.748 | 0.192 | 0.240 | 0.534 | 0.159 | 0.012 |
| c2 | 0.769 | 0.604 | 0.185 | 0.230 | 0.523 | 0.161 | 0.016 |
| c3 | 0.879 | 0.688 | 0.190 | 0.230 | 0.531 | 0.162 | 0.012 |
| c4 | 0.817 | 0.802 | 0.191 | 0.231 | 0.536 | 0.160 | 0.016 |
| Honsel | 0.861 | 0.545 | 0.184 | 0.213 | 0.580 | 0.162 | 0.021 |

Alloys a1-a4 were selected to fairly correspond to the coordinate points a1-a2-a3-a4 of claim 1 of the present invention. There were some difficulties hitting the exact composition of the a1-a4 corners.

Alloys c1-c4 were aimed at the coordinate points c1-c2-c3-c4 of claim 3 of the present invention. There were also here some practical difficulties obtaining the exact composition of the corners.

The Honsel alloy was targeted or picked outside the defined scope of the present invention to demonstrate that a too high Mg/Si ratio typically will give too low mechanical properties to meet C28 requirements.

Comments to Alloys a1-a4, as Shown in FIG. 21.

As to the a1-a4 alloys shown in FIG. 21, alloy a1 meets the C28 requirement in a T6 condition. Both the underaged condition T6x-2 h/185 and the overaged condition T7-4 h/205 do not meet the strength requirement.

Alloy a2 does not meet the C28 requirement in strength in any temper condition, but it can be used for a C24 requirement.

Alloy a3 is on the high side with respect to Rp0.2 value in the T7 condition. A few cracks can be observed but the crush behavior could be acceptable for other profiles which are more forgiving or rather less critical when it comes to crush behavior. With slightly more over-ageing the crush behavior would probably be excellent also for this profile. In a T6 condition the crush behavior is also quite good and not far from being acceptable. Also for this alloy the crush behavior is worst in the T6x conditions. Alloy a4 show a very high strength. Especially in the T6x condition the crush behavior is terrible. However, in a T7 condition the behavior is not too bad.

By comparing alloys a3-T6 and a4-T7 with approximately the same Rp0.2 values one can observe that alloy a3 shows the best crush behavior. This may indicate that a higher Mg/Si ratio is beneficial for the crush behavior.

Comments on Alloys c1-c4 and "Honsel" Alloy, as Shown in FIG. 22

FIG. 22 is, as stated above a bar diagram showing the mechanical properties of alloys c1-c4 of the second series tests plus an alloy named "Honsel" because the Mg and Si content fall within the patent by Honsel (in the patent by Honsel the alloys contain much lower amounts of Cr and Mn than in our "Honsel" example).

As can be observed from the figure all alloys c1-c4 show strength potential to meet the C28 requirement either in a condition close to T6 or in a T7 condition.

The results show that by aiming at Rp0.2 values in the range of 280-300 MPa the crush behaviour of all alloys within the c1-c2-c3-c4 rectangle will be very good.

Again, the T6x samples behave worse than both the T6 and the T7 samples with respect to crush behaviour.

The "Honsel" alloy has the same sum of Mg and Si but has a higher Mg/Si ratio than the alloys of the present invention. The crush behaviour is good, but the strength potential is too low to meet the C28 requirements. Therefore, the present invention has an upper Mg/Si ratio limited by the line between a3 and a4.

The above examples have shown that the Mg/Si ratio should be above 0.9 in order to have sufficient temperature stability and a Mg/Si ratio below 1.4 to get the necessary strength for C28 applications. Therefore, the alloy of the present invention is delimited by the coordinates a1 and a2, which define the lower Mg/Si ratio and the coordinates a3 and a4 which define the upper Mg/Si ratio (see FIGS. 3 and 20). Preferably the Mg/Si ratio should be delimited by the coordinates c1 and c2 (Mg/Si ratio close 1.0) and the coordinates c3 and c4 (Mg/Si ratio close to 1.3, see FIGS. 3 and 20).

Further tests were done with additional alloys with different Cu levels, as shown in table 5 below.

TABLE 5

| Alloy | Mg | Si | Fe | Cu | Mn | Cr | Ti |
|---|---|---|---|---|---|---|---|
| X1 - Cu1 | 0.696 | 0.567 | 0.190 | 0.122 | 0.554 | 0.162 | 0.017 |
| X1 - Cu2 | 0.695 | 0.570 | 0.195 | 0.228 | 0.559 | 0.161 | 0.018 |
| X1 - Cu3 | 0.688 | 0.569 | 0.193 | 0.317 | 0.559 | 0.160 | 0.014 |
| C2 - Cu1 | 0.762 | 0.701 | 0.185 | 0.121 | 0.549 | 0.160 | 0.018 |
| C2 - Cu2 | 0.778 | 0.701 | 0.184 | 0.228 | 0.556 | 0.162 | 0.014 |
| C2 - Cu3 | 0.776 | 0.701 | 0.186 | 0.318 | 0.559 | 0.162 | 0.012 |

Alloy X1 is an alloy with Mg and Si contents designed to meet C24 properties. The different Cu levels are included to show the effect of Cu on such an alloy.

Alloy C2 is an alloy with Mg and Si contents designed to meet C28 properties. The different Cu levels are included to show the effect of Cu on such an alloy.

Comments on alloys X1-Cu1, X1-Cu2 and X1-Cu3 shown in FIG. 23.

The X1 alloy has a Mg and Si content which is designed to meet the C24 requirement and not the C28 requirement. Another way to increase the strength is to add Cu. When the Cu content increases from 0.12 to 0.32 wt % Rp0.2 increases by 27 MPa and Rm by 28 MPa in the T6 condition.

By looking at the pictures in FIG. 29 showing the crush behaviour of the different alloy variants in a T7 condition, one can observe that the performance is almost independent of the Cu level. This indicates that a high Cu level is beneficial for obtaining a high strength and a corresponding good crush performance.

The positive effect of Cu on strength and crush behaviour must be balanced with the possible negative effects of Cu on corrosion behaviour and on the maximum extrusion speed.

Comments to alloys C2-Cu1, C2-Cu2 and C2-Cu3 shown in FIG. 24.

The C2 alloy has a Mg and Si content which is designed to meet the C28 requirement.

When the Cu content increases from 0.12 to 0.32 wt % Rp0.2 increases by 37 MPa and Rm by 35 MPa in the T6 condition.

By looking at the pictures (not depicted in the application) showing the crush behaviour of the different alloy variants, one can observe that the performance is slightly better for the lower Cu levels with corresponding lower strength levels. However, the difference in crush behaviour is minor and it indicates that a high Cu level is beneficial for obtaining a high strength and a corresponding good crush performance.

Still further tests of additional alloys with different Ti levels

Table 6 below shows tested alloys with different Ti levels:

TABLE 6

| Alloy | Mg | Si | Fe | Cu | Mn | Cr | Ti |
|---|---|---|---|---|---|---|---|
| X1 - Ti1 | 0.683 | 0.559 | 0.192 | 0.217 | 0.573 | 0.160 | 0.016 |
| X1 - Ti2 | 0.670 | 0.545 | 0.191 | 0.213 | 0.571 | 0.160 | 0.073 |
| X1 - Ti3 | 0.672 | 0.558 | 0.201 | 0.216 | 0.580 | 0.159 | 0.108 |
| C2 - Ti1 | 0.764 | 0.686 | 0.184 | 0.214 | 0.578 | 0.162 | 0.015 |
| C2 - Ti2 | 0.764 | 0.694 | 0.190 | 0.217 | 0.585 | 0.161 | 0.063 |
| C2 - Ti3 | 0.810 | 0.698 | 0.196 | 0.219 | 0.593 | 0.162 | 0.111 |

Alloy X1 is an alloy with Mg and Si contents designed to meet C24 properties. The different Ti levels are included to show the effect of Ti on such an alloy where the corrosion properties is the most important factor.

Alloy C2 is an alloy with Mg and Si contents designed to meet C28 properties. The different Ti levels are included to show the effect of Ti on such an alloy.

Comments on Alloys X1-Ti1, X1-Ti2 and X1-Ti3 as Shown in FIG. 25.

The strength seems to be unaffected by the Ti level in the alloy. From the crush tests on these alloys, all samples performed well and it was not possible to see any clear trends on the crush behaviour from the Ti additions.

Comments on Alloys C2-Ti1, C2-Ti2 and C2-Ti3 as Shown in FIG. 26.

The yield strength seems to be slightly lower for high Ti contents, but the difference is small and can be within experimental errors. As for the X1 variants, all samples performed well and it was not possible to see any clear trends on the crush behaviour from the Ti additions according to the C2 variants.

Inter granular corrosion test results of alloys with different Cu- and Ti-contents. Corrosion test were performed with alloys with different Ti and Cu levels as set out in the tables below.

TABLE 7

| Alloy | Mg | Si | Fe | Cu | Mn | Cr | Ti |
|---|---|---|---|---|---|---|---|
| X1 - Cu1 | 0.696 | 0.567 | 0.190 | 0.122 | 0.554 | 0.162 | 0.017 |
| X1 - Cu2 | 0.695 | 0.570 | 0.195 | 0.228 | 0.559 | 0.161 | 0.018 |
| X1 - Cu3 | 0.688 | 0.569 | 0.193 | 0.317 | 0.559 | 0.160 | 0.014 |

TABLE 8

| Alloy | Mg | Si | Fe | Cu | Mn | Cr | Ti |
|---|---|---|---|---|---|---|---|
| C2 - Cu1 | 0.762 | 0.701 | 0.185 | 0.121 | 0.549 | 0.160 | 0.018 |
| C2 - Cu2 | 0.778 | 0.701 | 0.184 | 0.228 | 0.556 | 0.162 | 0.014 |
| C2 - Cu3 | 0.776 | 0.701 | 0.186 | 0.318 | 0.559 | 0.162 | 0.012 |

TABLE 9

| Alloy | Mg | Si | Fe | Cu | Mn | Cr | Ti |
|---|---|---|---|---|---|---|---|
| X1 - Ti1 | 0.683 | 0.559 | 0.192 | 0.217 | 0.573 | 0.160 | 0.016 |
| X1 - Ti2 | 0.670 | 0.545 | 0.191 | 0.213 | 0.571 | 0.160 | 0.073 |
| X1 - Ti3 | 0.672 | 0.558 | 0.201 | 0.216 | 0.580 | 0.159 | 0.108 |

TABLE 10

| Alloy | Mg | Si | Fe | Cu | Mn | Cr | Ti |
|---|---|---|---|---|---|---|---|
| X1 - Ti1 | 0.683 | 0.559 | 0.192 | 0.217 | 0.573 | 0.160 | 0.016 |
| X1 - Ti2 | 0.670 | 0.545 | 0.191 | 0.213 | 0.571 | 0.160 | 0.073 |
| X1 - Ti3 | 0.672 | 0.558 | 0.201 | 0.216 | 0.580 | 0.159 | 0.108 |

The alloys were all tested according to the BS ISO 11846 standard.

Three parallel samples were run for each of the alloy variants (photos of samples subjected to testing are not depicted in the present application).

In general, all the samples seemed to have relatively small corrosion attacks and it was hard to find visible attacks by looking down at the corroded surfaces. When an attack was found one tried to hit this corroded area with the cross sectional cut. In the cases where no attacks were observed, an arbitrary cross sectional cut was made.

Of the X1 alloy variants with different Cu additions the one with the medium amount of Cu seems to be the worst variant.

Of the C2 alloy variants with different Cu additions the corrosion attacks seem to increase with increasing Cu content.

For the X1 alloy variants with different Ti additions the corrosion attacks seem to decrease with increasing Ti content.

For the C2 alloy variants with different Ti additions there was only one single corrosion attack for all the three variants and the three parallel samples. This attack was observed on the alloy variant with medium Ti content. This is not fully in accordance with the previous observations, but could be caused by a sample manufacturing error etc. which has not been further investigated.

The invention claimed is:

1. An extrudable Al—Mg—Si aluminium ahoy with improved strength, corrosion resistance, crush properties and temperature stability; useful in a front structure of vehicles, wherein:

the alloy has a composition defined within following coordinate points of an Mg—Si diagram:

a1-a2-a3-a4, wherein wt % a1=0.60Mg, 0.65Si, a2=0.90Mg, 1.0Si, a3=1.05Mg, 0.75Si and a4=0.70 Mg, 0.50Si, and the alloy comprises a non-recrystallized grain structure in an extruded profile comprising additional following alloy components in wt %:

Fe up to 0.30,

Cu 0.1-0.4,

Mn 0.50-0.70,

Cr 0.10-0.20,

Zr up to 0.25,

Ti 0.005-0.15, and incidental impurities up to 0.1 each and including Zn up to 0.5, with balance Al.

2. The alloy according to claim 1, wherein Mg/Si ratio is between 0.9-1.4.

3. The alloy according to claim 1, wherein the alloy is defined within coordinate points b1-b2-b3-b4, where in wt % b1=0.76 Mg, 0.55Si, b2=1.02 Mg, 0.74Si, b3=0.90 Mg, 0.91 Si and b4=0.67 Mg, 0.68 Si.

4. The alloy according to claim 1, wherein the alloy is defined between the coordinate points c1-c2-c3-c4, where in wt % c1=0.80 Mg, 0.59 Si, c2=0.94 Mg, 0.70 Si, c3=0.85 Mg, 0.84 Si and c4=0.72 Mg, 0.71 Si.

5. The alloy according to claim 1, wherein Mg/Si ratio is between 1.0-1.3.

6. The alloy according to claim 1, comprising Fe between 0.10-0.28 wt %.

7. The alloy according to claim 1, comprising Cu between 0.15-0.30 wt %.

8. The alloy according to claim 1, wherein the alloy is homogenized at a temperature of 520-590° C. for 0.5-24 hours and a cooling rate after homogenization is more than 200° C./hour at 520 to 250° C.

9. The alloy according to claim 1, wherein the alloy is homogenized at a temperature of 540-580° C. for 2-10 hours.

10. The alloy according to claim 1, wherein the alloy is cast to billets and then homogenized.

11. The alloy according to claim 1, wherein the alloy is reheated to a preferred temperature and then extruded.

12. The alloy according to claim 1, wherein the extruded profile produced from the alloy is water quenched from a temperature between 500-580° C. down to a temperature below 200° C.

13. The alloy according to claim 1, wherein the alloy is overaged at a temperature between 185-215° C. for a period between 1-25 hours.

14. The alloy according to claim 1, wherein the alloy is overaged at a temperature between 200-210° C. for a period between 2-8 hours.

* * * * *